US005849220A

United States Patent [19]

Batton et al.

[11] Patent Number: 5,849,220

[45] Date of Patent: Dec. 15, 1998

[54] CORROSION INHIBITOR

[75] Inventors: Carol B. Batton, Naperville; Tzu-Yu Chen; Christopher C. Towery, both of Lisle, all of Ill.

[73] Assignee: Nalco Chemical Company, Naperville, Ill.

[21] Appl. No.: 13,561

[22] Filed: Jan. 26, 1998

Related U.S. Application Data

[62] Division of Ser. No. 657,724, May 30, 1996, abandoned.

[51] Int. Cl.[6] ..... C09K 3/00

[52] U.S. Cl. ..... 252/396; 422/14

[58] Field of Search ..... 252/396; 422/14

[56] References Cited

U.S. PATENT DOCUMENTS

| | | | |
|---|---|---|---|
| 3,373,173 | 3/1968 | Foley et al. . | |
| 3,438,797 | 4/1969 | Biddle . | |
| 3,542,044 | 11/1970 | Hansen . | |
| 3,763,047 | 10/1973 | Fairs . | |
| 3,977,994 | 8/1976 | Geiser . | |
| 4,325,861 | 4/1982 | Braun et al. . | |
| 4,401,579 | 8/1983 | Kratzer . | |
| 4,687,634 | 8/1987 | Baseman et al. | 422/7 |
| 4,770,874 | 9/1988 | Allison et al. . | |
| 4,846,980 | 7/1989 | Valone . | |
| 4,892,729 | 1/1990 | Cavazza . | |
| 4,970,026 | 11/1990 | Mullins et al. | 252/389.62 |
| 5,082,592 | 1/1992 | McDonald . | |
| 5,330,653 | 7/1994 | Vroman . | |
| 5,368,775 | 11/1994 | Rossi et al. . | |

FOREIGN PATENT DOCUMENTS

| | | |
|---|---|---|
| 0 108 536 B1 | 12/1990 | European Pat. Off. . |
| PCT/AU84/ 00215 | 10/1984 | WIPO . |

*Primary Examiner*—Jacqueline V. Howard
*Assistant Examiner*—Cephia D. Toomer
*Attorney, Agent, or Firm*—Kelly L. Cummings; Thomas M. Breininger

[57] ABSTRACT

A corrosion inhibiting composition for use in inhibiting corrosion of metallic surfaces, the composition comprising a first surfactant wherein the first surfactant includes at least one sorbitan fatty acid ester and a second surfactant wherein the second surfactant includes at least one polyoxyethylene derivative of a sorbitan fatty acid ester.

20 Claims, 8 Drawing Sheets

CORROSION INHIBITOR

This application is a division of Ser. No. 08/657,724, filed May 30, 1996, now abandoned.

FIELD OF THE INVENTION

The present invention relates generally to the protection of metallic surfaces from corrosion in both the vapor and liquid phases of aqueous and non-aqueous fluid systems. More specifically, the present invention relates to corrosion inhibiting compositions and methods of using the same.

BACKGROUND OF THE INVENTION

Corrosion of metallic components in the plants may cause system failures and sometimes plant shutdowns. In addition, corrosion products accumulated on the metal surface will decrease the rate of heat transfer between the metal surface and the water or other fluid media and therefore corrosion will reduce the efficiency of the system operation. Therefore corrosion can increase maintenance and production costs.

The most common way to combat corrosion is to add corrosion inhibiting additives to the fluid of such systems. However, currently available corrosion inhibiting additives are either non-biodegradable, toxic, or both, which limits the applicability of such additives.

The most common anti-corrosion additives used in connection with boiler condensate systems are neutralizing amines and filming amines. While amines and combinations of amines generally provide effective protection against the corrosion of steel and other ferrous-containing metals, the use of amines in anti-corrosion additives presents several problems.

First amines often undergo thermal decomposition at high temperatures and form ammonia which can be very corrosive to copper and copper alloys especially in the presence of oxygen. Thus, amine-containing corrosion inhibitors are often unsatisfactory for use in systems containing copper or copper alloy metallurgies.

Further, in a number of applications including food processing, beverage production, co-generation plants, and pharmaceutical manufacturing, the use of amines is limited due to governmental regulations or concerns for taste and odor problems. Consequently, in many of these applications, no anti-corrosion treatment program is used at all. Therefore, these systems are susceptible to high corrosion rates, significant maintenance costs and high equipment failure rate.

U.S. Pat. No. 5,368,775 discusses a couple of methods of controlling acid induced corrosion. In one method, a thin film is used as a barrier between the metal surface to be protected and the acidic solution. Long chain amines such as octadecyl amine or azoles are used to form the thin film. The second method requires the addition of neutralizing amines to neutralize the acid and raise the aqueous pH. The best amines for this method are described as having a high basicity and a low molecular weight. Cyclohexylamine, dimethylamine, trimethylamine, morpholine, and methoxypropylamine were cited as examples of neutralizing amines.

In the present invention a blend of at least two compounds typically used in compositions as surfactants surprisingly provide protection of metallic surfaces from corrosion in aqueous and non-aqueous solutions.

PCT application, number AU84/00215 discloses a foamable biocide composition comprising an alcoholic chlorohexidine solution, quick breaking foaming agent, an aerosol propellant, and corrosion inhibitor to counter the corrosive nature of the alcoholic chlorohexidine solution. The quick breaking foaming agent contains, as one of its ingredients, a surface active agent, preferably an ethoxylated sorbitan ester. The surface active agent acts as an emulsifier. Examples of the preferred emulsifier given include ethoxylated sorbitan stearate, palmitate, and oleate; nonyl phenol ethoxylates; and, fatty alcohol ethoxylates.

U.S. Pat. No. 3,977,994 discloses a rust inhibiting composition. The composition is a mixture of an organic acid, an N-alkyl or cycloalkyl substituted ethanolamine, and water. In some cases, the composition may also contain at least one emulsifying agent to permit the emulsion of the organic acid and the ethanolamine. Examples of the emulsifying agent include sorbitan derivatives.

U.S. Pat. No. 4,970,026 teaches a corrosion inhibitor for ferrous and non-ferrous aqueous systems. The composition comprises a component selected from naphthenic oil based sodium salt of a triethanolamine alkylsulfamido carboxylic acid; a paraffinic oil based sodium salt of a triethanolamine alkylsulfamido carboxylic acid; a sodium salt of an alkylsulfamido carboxylic acid; and a mixture consisting of two choices as well as a surfactant selected from a long chain fatty acid derivative of sarcosine and a condensation product of ethylene oxide and a fatty acid.

The inhibiting effects are attributed to the component or mixture of components, not to the addition of the surfactant. In fact, the patent states that the surfactants were tested separately for their effectiveness as corrosion inhibitors. The surfactants were found to be ineffective as corrosion inhibitors.

U.S. Pat. No. 5,082,592 disclosed a method for inhibiting corrosion for ferrous metals in aqueous solution comprising a nonionic surfactant and an anionic oxygen containing group such as alkali metal salts of borate, molybdate, and nitrate/nitrite. The preferred nonionic surfactant is phenol/polyethylene oxide.

It is postulated in the specification that the nonionic surfactant increases the corrosion inhibition properties of the anions. The inhibition properties of the anions result from their adsorption at the interface of the metal surface and the solution. It is believed that the co-absorption of the nonionic surfactant serves to maximize the surface concentration of the anions by shielding anions' hydrostatic repulsive forces.

EPO patent application, number 0 108 536 B1 discloses a method for protecting metal surfaces from corrosion. The method uses a composition of a corrosion inhibitor with a thickening agent. The corrosion inhibitor may include carboxylic acid esters of sorbitan. In combination with a thickening agent, the corrosion inhibitor is pseudoplastic and thixotropic. The composition forms a gel upon standing. The composition forms a soft flexible coating which can replace paints, varnishes, lacquers, plastics and metal coatings frequently used to protect metal surfaces from corrosion.

Therefore, there is a strong need for a corrosion-inhibiting non-amine at least less toxic additive which is a more environmentally acceptable alternative.

SUMMARY OF THE INVENTION

The present invention provides an improved corrosion inhibiting composition for use in aqueous and non-aqueous fluid systems (application may be in either the liquid or vapor phase or in both phases of the fluid) and in connection with most metallic surfaces including ferrous-containing, copper and copper alloy surfaces. Pursuant to the present invention, the corrosion inhibiting composition comprises a combination of two or more surfactants.

In an embodiment, a combination of a sorbitan fatty acid ester with a polyoxyethylene derivative of a sorbitan fatty acid ester is provided. The above combination provides a corrosion inhibiting composition that is free of amines, that is believed to be at least less toxic and more environmentally acceptable.

In an embodiment, a corrosion inhibiting composition is provided which includes at least two surfactants. Each surfactant alone can provide some corrosion protection under certain conditions. However, a synergistic effect can be observed when these surfactants are present simultaneously. A first surfactant is characterized as a sorbitan fatty acid ester and is selected from a group consisting of: sorbitan tristearate; sorbitan monostearate; sorbitan monolaurate; sorbitan monopalmitate; sorbitan monooleate; sorbitan sesquioleate; and, sorbitan trioleate. A second surfactant characterized as a polyoxyethylene derivative of a sorbitan fatty acid ester is selected from a group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate, and, polyoxyethylene 20 sorbitan trioleate.

In an embodiment, the weight ratio of the sorbitan fatty acid ester surfactant to the polyoxyethylene derivative of a sorbitan fatty acid ester surfactant ranges from about 1:3 to about 2:1.

In an embodiment, a combination of at least two surfactants is added to a system to be treated at a dosage level ranging from about 0.1 ppm to about 500 ppm.

In an embodiment, a formulated product containing corrosion inhibiting surfactants is provided which includes from about 1% to about 50% total surfactant, of which about 40% of the surfactants are sorbitan fatty acid esters and about 60% of the surfactants are polyoxyethylene derivatives of sorbitan fatty acid esters.

In an embodiment, the present invention provides a method of reducing corrosion on metallic surfaces caused by corrosive solutions. The method includes the step of adding a corrosion inhibiting composition to the solution, the composition including a first surfactant and at least a second surfactant.

In an embodiment, the present invention provides a method of reducing corrosion on metallic surfaces caused by corrosive solutions. The method includes the step of adding a corrosion inhibiting composition to the solution, the composition including a combination of a sorbitan fatty acid ester with a polyoxyethylene derivative of a sorbitan fatty acid ester.

In an embodiment, the present invention provides a method of reducing corrosion on metallic surfaces caused by corrosive solutions. The method includes the step of adding a corrosion inhibiting composition to the solution, the composition including a combination of a sorbitan fatty acid ester selected from the group consisting of: sorbitan tristearate; sorbitan monostearate; sorbitan monolaurate; sorbitan monopalmitate; sorbitan monooleate; sorbitan sesquioleate; and, sorbitan trioleate with a polyoxyethylene derivative of a sorbitan fatty acid ester selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate.

In an embodiment, a solution is provided which includes a corrosive liquid in combination with a sorbitan fatty acid ester with a polyoxyethylene derivative of a sorbitan fatty acid ester.

The above combinations provide a corrosion inhibiting composition that is free of amines, that is believed to be at least less toxic and more environmentally acceptable.

A corrosion inhibiting composition of the present invention may be added continuously or periodically as a slug feed.

An advantage of the present invention is to provide an improved corrosion inhibiting composition for use in connection with metallic surfaces.

Another advantage of the present invention is to provide an improved corrosion inhibiting composition that is believed to be at least less toxic.

Still another advantage of the present invention is to provide an improved corrosion inhibiting composition that is more environmentally acceptable.

A further advantage of the present invention is to provide an improved corrosion inhibiting composition which includes a combination of at least two non-amine containing surfactants.

Yet another advantage of the present invention is to provide a new use for sorbitan fatty acid esters.

Another advantage of the present invention is to provide a new use for polyoxyethylene derivatives of sorbitan fatty acid esters.

A further advantage of the present invention is to provide improved corrosion-inhibiting compositions which have aqueous and non-aqueous applications.

Yet another advantage of the present invention is to provide a corrosion-inhibiting composition for use in boiler condensate and cooling water, water treatment applications, refinery and oil field processes, food processing, pulp and paper mill applications, electronics and electronic circuits manufacturing, metal industries, mining and ore processing applications, beverage production, co-generation plants, hospital sanitation systems and pharmaceutical manufacturing.

A still further advantage of the present invention is to provide a corrosion-inhibiting composition that is effective over a broad pH range especially in slightly acidic solutions (preferably between the pHs of 4 and 9).

An additional advantage of the present invention is to provide an improved corrosion-inhibiting composition that is effective in both deaerated and aerated solutions.

Additional features and advantages are described in, and will be apparent from, the detailed description of the presently preferred embodiments and from the figures.

DESCRIPTION OF THE PREFERRED EMBODIMENTS

Figure 1:
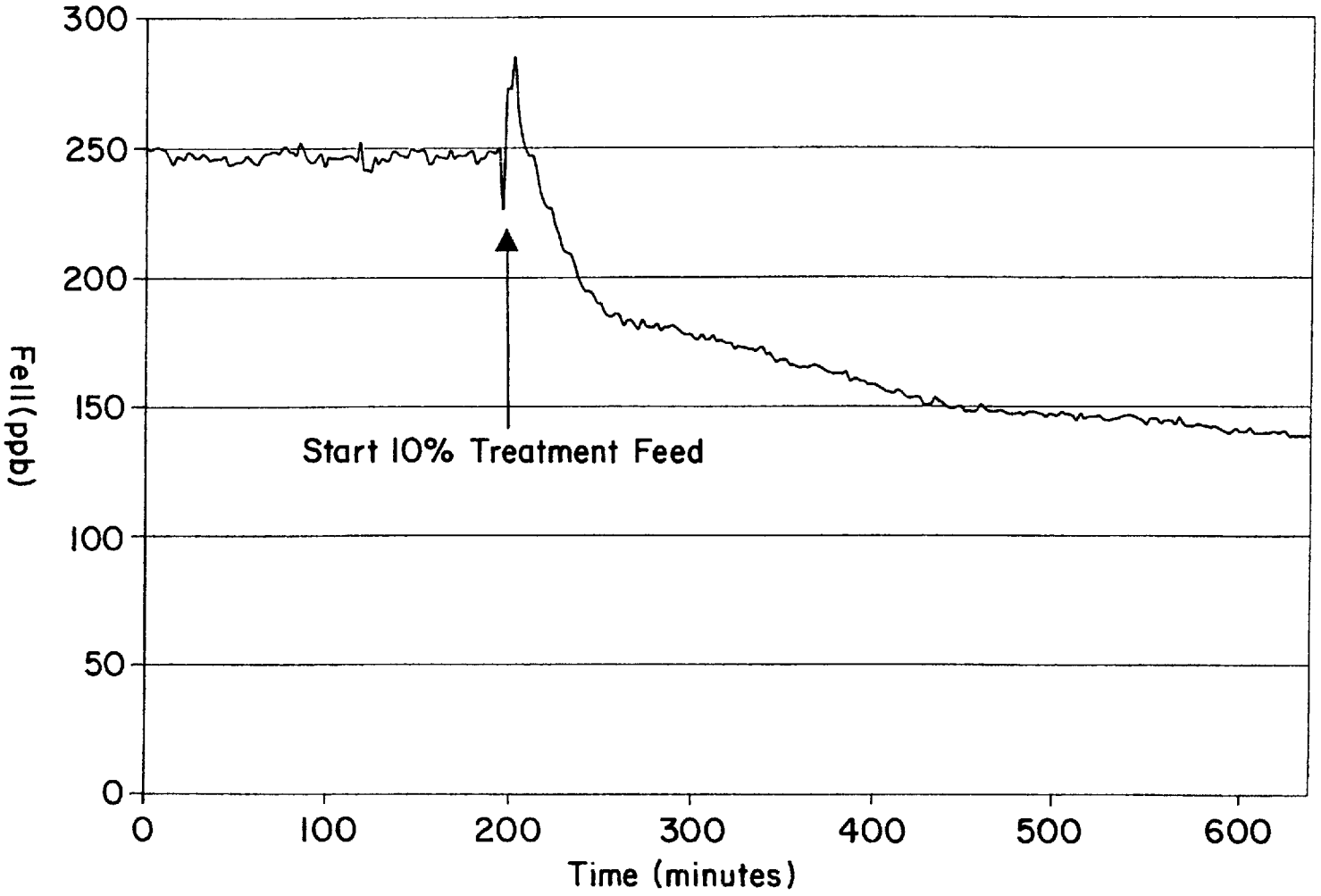
FIG. 1 illustrates, graphically, a net reduction in soluble iron level over time after treatment of a system with a corrosion inhibitor prepared in accordance with the present invention.

The present invention provides an improved corrosion inhibiting composition that is believed to be at least less toxic and more environmentally acceptable. In a preferred embodiment, the corrosion inhibiting composition includes a combination of at least two surfactants.

One embodiment of the present invention is a corrosion inhibiting composition for use in inhibiting corrosion of metallic surfaces. The composition comprises a first surfactant which includes at least one sorbitan fatty acid ester and a second surfactant which includes at least one polyoxyethylene derivative of a sorbitan fatty acid ester.

The weight ratio of the first surfactant to the second surfactant in the composition is preferably from about 1:3 to about 2: 1, more preferably from about 1:2 to about 2:1, and most preferably from about 1:1.

In addition, an emulsifier, different from the first surfactant and the second surfactant, may be added to the composition, providing stabilization for the composition for shipping, handling, and storage. In addition, the emulsifier aids in the thixotropy characteristics of the composition, maintaining fluidity of the composition under a variety of conditions.

The emulsifier can be selected from the group consisting of: polyoxyethylene 20 sorbitan monolaurate; polyoxyethylene 4 sorbitan monolaurate; polyoxyethylene 20 sorbitan monostearate; and, polyoxyethylene 20 sorbitan monopalmitate. In cases where an emusifier is added to the composition, the weight ratio of the first surfactant to the second surfactant to the emulsifier in the composition is preferably from about 1:3:0.4 to about 2:1:0.3, more preferably from about 1:2:0.3 to about 2:1:0.3, and most preferably from about 1:1:0.2.

In another embodiment of the composition, at least one of the sorbitan fatty acid esters in the first surfactant is selected from the group consisting of: sorbitan tristearate; sorbitan monostearate; sorbitan monolaurate; sorbitan monopalmitate; sorbitan monooleate; sorbitan sesquioleate; and, sorbitan trioleate. It is believed that other sorbitan fatty acid esters and glycerol fatty acid esters will also be useful.

At least one of the polyoxyethylene derivatives of a sorbitan fatty acid ester in the second surfactant may be selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate. It is believed that other derivatives of sorbitan fatty acid esters will be useful as well.

The surfactants used in this invention, while typically used as emulsifiers, function as corrosion inhibitors. The combination of surfactants provide protection against corrosion that exceeds the sum of protection against corrosion when the surfactants used separately. The synergism of the invention combinations provide surprisingly effective corrosion inhibition.

In another embodiment, the composition may comprise a first surfactant including at least one of the sorbitan fatty acid ester selected from the group consisting of: sorbitan tristearate; sorbitan monostearate; sorbitan monolaurate; sorbitan monopalmitate; sorbitan monooleate; sorbitan sesquioleate; and, sorbitan trioleate; and the second surfactant includes at least one of the polyoxyethylene derivatives of a sorbitan fatty acid ester selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate.

Another embodiment of the invention is a method of inhibiting corrosion on metallic surfaces in contact with a fluid contained in an industrial fluid system. The method comprises adding an effective corrosion controlling amount of the composition to the fluid in the industrial fluid system. The composition comprises a first surfactant which includes at least one sorbitan fatty acid ester and a second surfactant which includes at least one polyoxyethylene derivative of a sorbitan fatty acid ester. The fluid may be an aqueous fluid or a non-aqueous fluid.

The weight ratio of the first surfactant to the second surfactant in the composition used in the invention method is preferably from about 1:3 to about 2:1, more preferably from about 1:2 to about 2:1, and most preferably from about 1:1.

In addition, an emulsifier, different from the first surfactant and the second surfactant, may be added to the composition, providing stabilization for the composition. The emulsifier can be selected from the group consisting of: polyoxyethylene 20 sorbitan monolaurate; polyoxyethylene 4 sorbitan monolaurate; polyoxyethylene 20 sorbitan monostearate; and, polyoxyethylene 20 sorbitan monopalmitate. In cases where an emulsifier is added to the composition used in the method, the weight ratio of the first surfactant to the second surfactant to the emulsifier in the composition is preferably from about 1:3:0.4 to about 2:1:0.3, more preferably from about 1:2:0.3 to about 2:1:0.3, and most preferably from about 1:1:0.2.

In another embodiment of the composition used in the invention method, at least one of the sorbitan fatty acid esters in the first surfactant is selected from the group consisting of: sorbitan tristearate; sorbitan monostearate; sorbitan monolaurate; sorbitan monopalmitate; sorbitan monooleate; sorbitan sesquioleate; and, sorbitan trioleate. It is believed that other sorbitan fatty acid esters and glycerol fatty acid esters will also be useful.

At least one of the polyoxyethylene derivatives of a sorbitan fatty acid ester in the second surfactant may be selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate. It is believed that other derivatives of sorbitan fatty acid esters will be useful as well.

In another embodiment the composition used in the invention method may comprise a first surfactant includes at least one of the sorbitan fatty acid ester selected from the group consisting of: sorbitan tristearate; sorbitan monostearate; sorbitan monolaurate; sorbitan monopalmitate; sorbitan monooleate; sorbitan sesquioleate; and, sorbitan trioleate; and the second surfactant includes at least one of the polyoxyethylene derivatives of a sorbitan fatty acid ester selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate.

The pH of the fluid is preferably from about 4 to about 9, more preferably from about 5 to about 8, and most preferably from about 5.5 to about 7.5. The temperature of the fluid ranges typically from about 70° F. to about 550° F., more preferably from 70° F. to about 510° F., most preferably from about 70° F. to about 490° F. The composition can be injected directly into either the vapor or liquid phases or both phases of the fluid system.

The composition used in the invention method which contains at least a first surfactant and a second surfactant may be added to the fluid so that the concentration of composition in the fluid ranges preferably from about 0.1 ppm to about 500 ppm, more preferably from about 0.5 ppm to about 200 ppm, most preferably from about 0.5 ppm to about 100 ppm of total surfactant concentration.

The composition used in the invention method which contains at least a first surfactant, a second surfactant, and at least one emulsifier may be added to the fluid so that the concentration of composition in the fluid ranges preferably from about 0.1 ppm to about 500 ppm, more preferably from about 0.5 ppm to about 200 ppm, most preferably from about 0.5 ppm to about 100 ppm of total surfactant concentration. The concentration of the emulsifier is about one tenth the total surfactant concentration. So if 500 ppm total surfactant concentration of the composition is used, the emulsifier concentration that would be added to the composition would be about 50 ppm.

The industrial fluid system may be selected from the group consisting of: cooling water systems such as cooling towers; heat transfer systems such as boiler systems; refinery systems such as systems for the processing hydrocarbon feedstock; pulp and paper making systems; food and beverage systems such as thermal processing systems; and, mechanical coolant systems such as combustion engine coolant systems. The invention is also applicable to other examples of these systems which include a fluid system.

Suitable sorbitan fatty acid esters for use in the present invention have the following structures:

SORBITAN FATTY ACID ESTERS

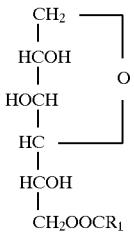

1,4 SORBITAN MONOESTER

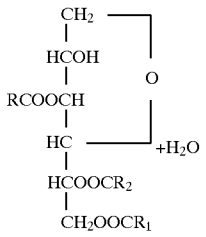

1,4 SORBITAN TRIESTER wherein $R_1CO$ and $R_2CO$ represents the fatty acid moiety. $R_1$ may be a stearic acid, lauric acid, palmitic acid, oleic acid or sesquioleic acid group. $R_2$ is preferably an oleic acid group.

Suitable polyoxyethylene derivatives of sorbitan fatty acid esters for use in the present invention have the following structure:

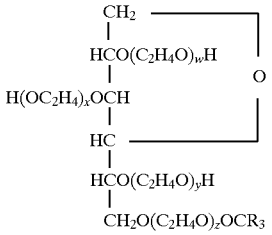

POLYOXYETHYLENE SORBITAN MONOESTER

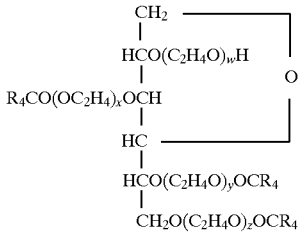

POLYOXYETHYLENE SORBITAN TRIESTER wherein $R_3CO$ and $R_4CO$ represents the fatty acid moiety. $R_3$ may be a stearic acid, tristearic acid, lauric acid, palmitic acid or oleic acid group. $R_4$ is preferably an oleic acid group. The total moles of ethoxylation (n) is equal to w+x+y+z.

In one embodiment the ratio of the first surfactant to the second surfactant is approximately 2:3, but the ratio may vary widely, from about 1:3 to about 2:1 depending upon the particular surfactants that are utilized. The dosage level or concentration may also vary widely, from about 0.1 ppm to about 500 ppm.

As illustrated in the examples below, the ability of the combination of present invention to reduce corrosion in steel, copper and other metallic apparati is highly unexpected in view of the limited inhibition effect of the components alone.

The following examples are presented to describe preferred embodiments and utilities of the invention and are not meant to limit the invention unless otherwise stated in the claims appended hereto.

EXPERIMENTAL PROCEDURE

Test Electrodes and Preparation Thereof

The test specimens (referred to herein as electrodes or test electrodes) used in the following examples were tubular mild (C1008 plain carbon) steel or copper. Each electrode was ½ inch in diameter and ½ inch in length. The electrodes were prepared by polishing with silicon carbide (SiC) paper to a final grit #600 finishing. The electrodes were then cleaned by rinsing with deionized water, an acetone rinse, and then air-dried for subsequent electrochemical measurements.

Each tubular electrode was supported on a stainless steel specimen holder with two Teflon spacers. The annular space between the electrode and the stainless steel shaft was filled with aluminum foil to provide an electrical connection. The specimen holder was isolated from the test solution by Teflon tapes and a Teflon sleeve. The edges of each electrode were then coated with a paint (Microstop) to avoid crevice corrosion.

Electrochemical Techniques

Potentiodynamic scans were run on the metal electrodes in order to analyze the corrosion inhibition effects of the various surfactants. Testing was done in deaerated or areated 0.1M sodium perchlorate ($NaClO_4$) solution in a 1000 ml glass cell. For deaerated experiments, the test solution was purged with zero grade argon gas for at least two hours before the test electrode was introduced. For aerated experiments, the tests were performed at a rotation speed of 500 rpm with a rotating cylinder electrode.

The temperature of the test solution was increased to 150° F. (over about a 20 minute period of time) by heating concurrently with deaeration. The pH was adjusted with dilute sodium hydroxide or perchloric acid solutions to desired values ranging from 4.0–9.0. Potentiodynamic polarization was then conducted at a potential scan rate of 0.5 mV/sec from the cathodic region to the anodic region.

Corrosion inhibition performance of the chemicals was investigated by comparing with a blank (a test solution containing no corrosion inhibiting composition of this invention) under the same test conditions based on the polarization curves. All potential measurements were made with respect to a silver/silver chloride (Ag/AgCl) reference electrode.

EXAMPLE 1

As illustrated in FIG. 1, corrosion-inhibition is provided in systems treated with a corrosion-inhibiting composition prepared in accordance with the present invention. Fell (ppb) used on FIG. 1 represents ferrous oxide (parts per billion). The test results illustrated in FIG. 1 were achieved under the following conditions. A simulated deaerated boiler condensate solution containing trace amounts of sodium perchlorate was fed into process simulation equipment at 80–100 ml/min and at approximately 180° F. The pH of the simulated boiler condensate solution was about 5.5.

As illustrated in FIG. 1, iron was present in excess of 240 ppb before a 200 ppm slug feed of corrosion inhibitor was added which consisted of a 1:1 ratio of sorbitan monostearate and polyoxyethylene 20 sorbitan monostearate. In less than five hours, the soluble iron concentration dropped from greater than 240 ppb to less than 150 ppb.

EXAMPLE 2

Figure 2:
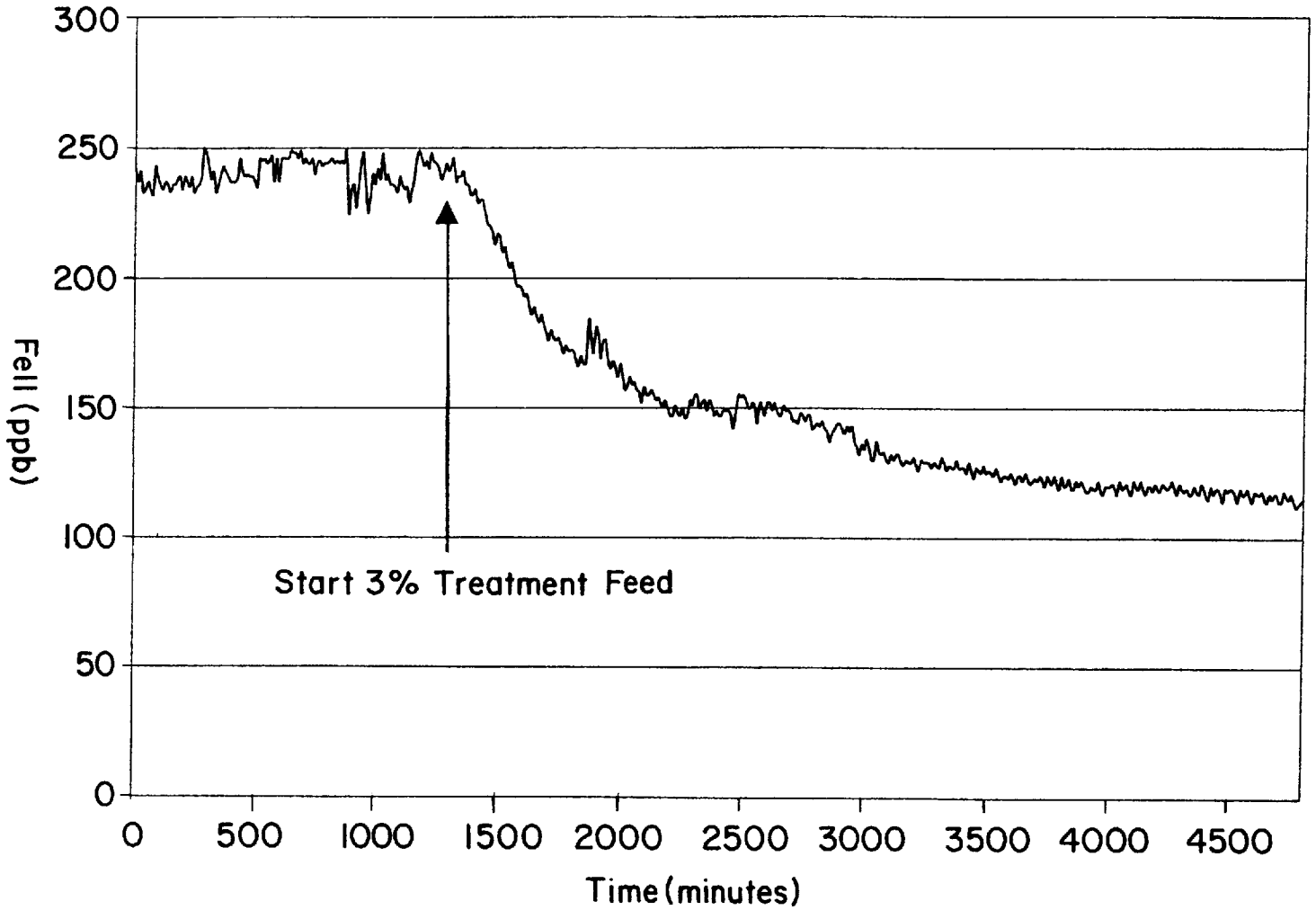
FIG. 2 illustrates, graphically, a reduction in soluble iron level over time after treatment of a system with a corrosion inhibitor prepared in accordance with the present invention.

The results illustrated in FIG. 2 were achieved under the same conditions discussed above with respect to FIG. 1 except that a 60 ppm continuous feed of the corrosion inhibitor of a 1:1 ratio of sorbitan monostearate and polyoxyethylene 20 sorbitan monostearate was utilized instead of the 200 ppm slug feed illustrated in FIG. 1. Fell (ppb) used on FIG. 2 represents ferrous oxide (parts per billion). As illustrated in FIG. 2, the iron concentration dropped from approximately 240 ppb to less than 150 ppb in about a twenty-four hour period. The lower iron concentration is indicative of a lower corrosion rate.

EXAMPLE 3

The corrosion inhibition action of the present invention is also demonstrated by potentiodynamic polarization measurements using polished tubular specimens of mild steel (FIGS. 3–7) or copper (FIG. 8) immersed in a 0.1M perchlorate solution at 150° F. The 0.1M perchlorate solution was used as the supporting electrolyte to increase the conductivity. FIGS. 3–8 are plots of applied potential versus measured current density. Units used on FIGS. 3–8 are E(MV) which is potential (mV), and I(UA/CM-2) which is current density ($\mu A/cm^2$).

Figure 3:
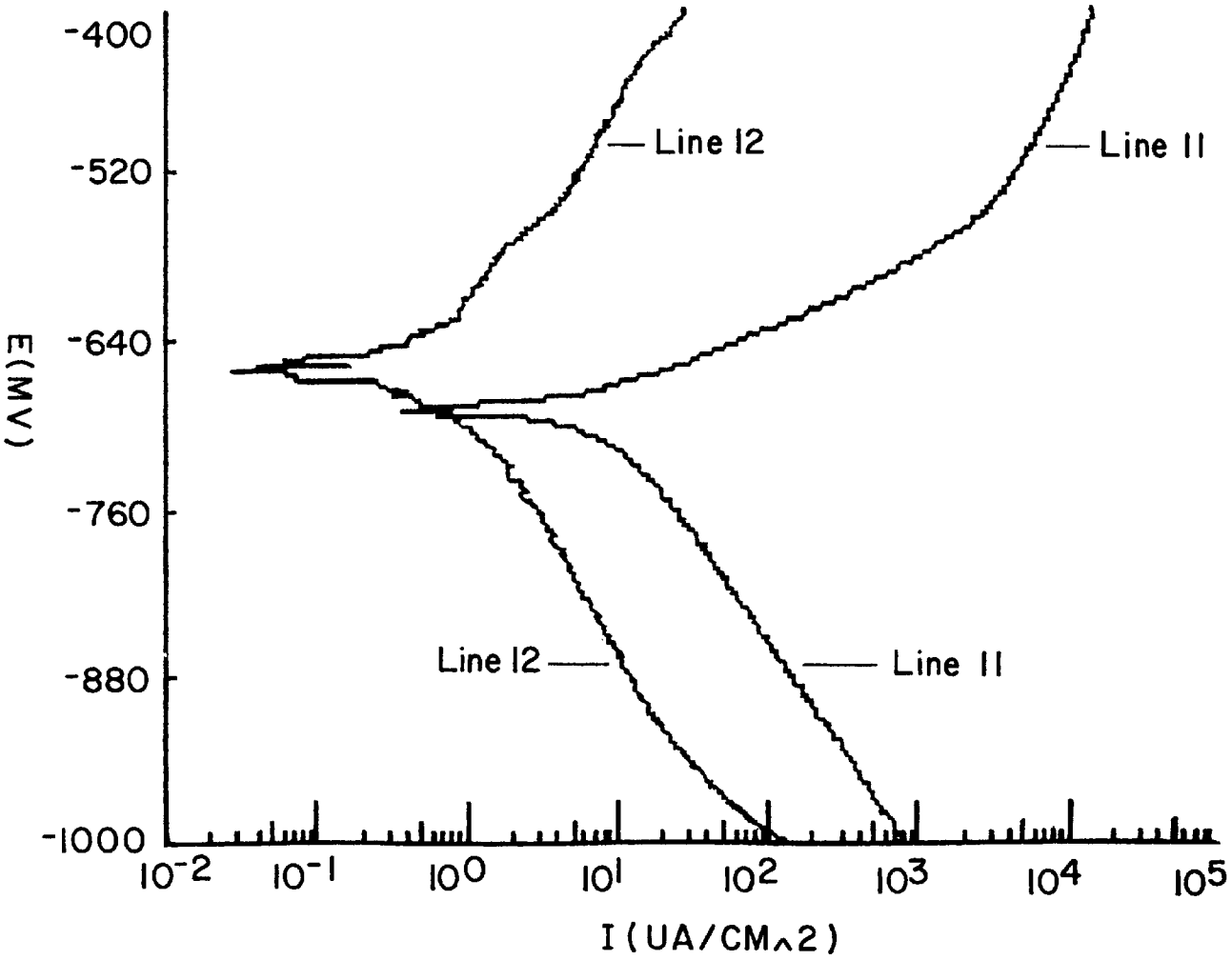
FIG. 3 illustrates, graphically, the corrosion inhibition effect in a system after treatment with a corrosion inhibitor prepared in accordance with the present invention.

Referring first to FIG. 3, the polarization curve in the presence of a corrosion inhibitor formulated in accordance with the present invention is compared with an untreated or blank solution. Specifically, line 11 represents the applied potential versus current density curve (or polarization curve) in a blank or untreated system. In contrast, line 12 represents the polarization curve in the same system after treatment with a 1:1 blend of sorbitan monostearate and polyoxyethylene 20 sorbitan monostearate each at 30 ppm dosage. The pH of the system was 6.5 and the system was deaerated. The polarization curve with treatment represented by line 12 shifts toward the left with respect to that represented by line 11 (representing the blank) indicating a substantial decrease in corrosion rate.

Figure 4:
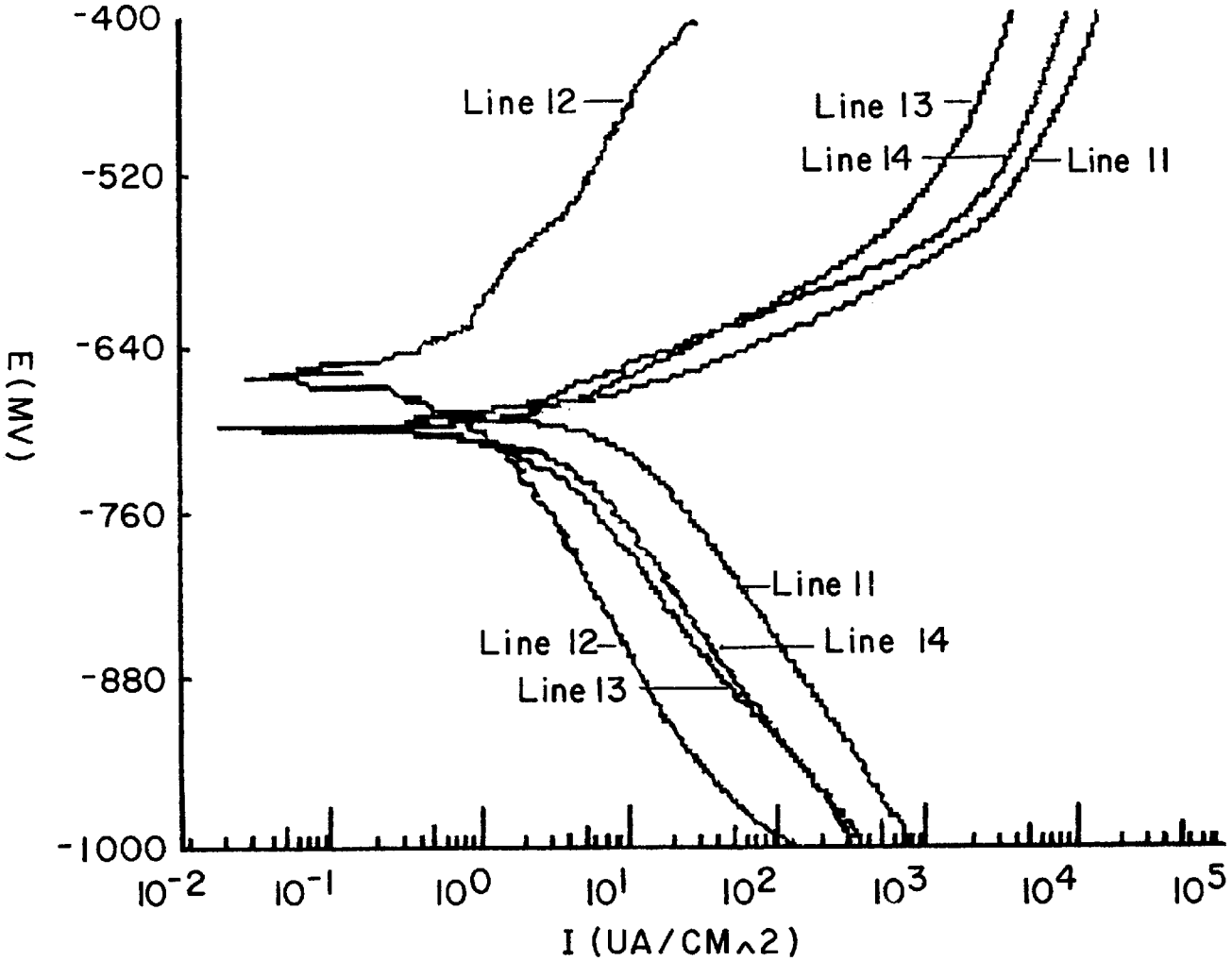
FIG. 4 illustrates, graphically, the polarization curve in an untreated system, two systems treated separately with individual components of a corrosion inhibitor and a system with combined components prepared in accordance with the present invention.

Referring to FIG. 4, line 11 represents the polarization curve in a blank or untreated system. Line 13 represents the polarization curve in the same system after treatment with 30 ppm of sorbitan monostearate, with no polyoxyethylene derivative. Line 14 represents the polarization curve of the same system after treatment with 30 ppm of polyoxyethylene 20 sorbitan monostearate, with no sorbitan monostearate.

The systems illustrated in FIG. 4, similar to those illustrated in FIG. 3, also had a pH of 6.5 and were also deaerated. In comparing FIGS. 3 and 4, it is evident that the combination of a sorbitan fatty acid ester (e.g. sorbitan monostearate) with a polyoxyethylene derivative of a sorbitan fatty acid ester (e.g. polyoxyethylene 20 sorbitan monostearate) provides a substantial synergistic effect on corrosion reduction in a treated system (as represented by line 12 in FIG. 4) as compared to the results produced by treating systems wherein the two components are used individually (as represented by lines 13 and 14 in FIG. 4).

In FIG. 4, the treatment using a sorbitan fatty acid ester (sorbitan monostearate) alone (as represented by line 13) provides some corrosion reduction especially in the cathodic region when compared to the untreated system (as represented by line 11). Similarly, the treatment using the polyoxyethylene derivative (polyoxyethylene 20 sorbitan monostearate) alone (as represented by line 14) provides some corrosion primarily due to cathodic inhibition when compared to the untreated system (as represented by line 11). In stark contrast, the treatment using the combination a sorbitan fatty acid ester with a polyoxyethylene derivative of a sorbitan fatty aid ester (as represented by line 12 of FIG. 4) provides a substantial corrosion reduction both in the cathodic region and the anodic region with anodic inhibition being more significant. Hence, the treatment of a system using one of the two surfactants alone provides some corrosion inhibition; however, the treatment using the combination of the two surfactants provides a synergistic, amine-free corrosion inhibition.

EXAMPLE 4

Figure 5:
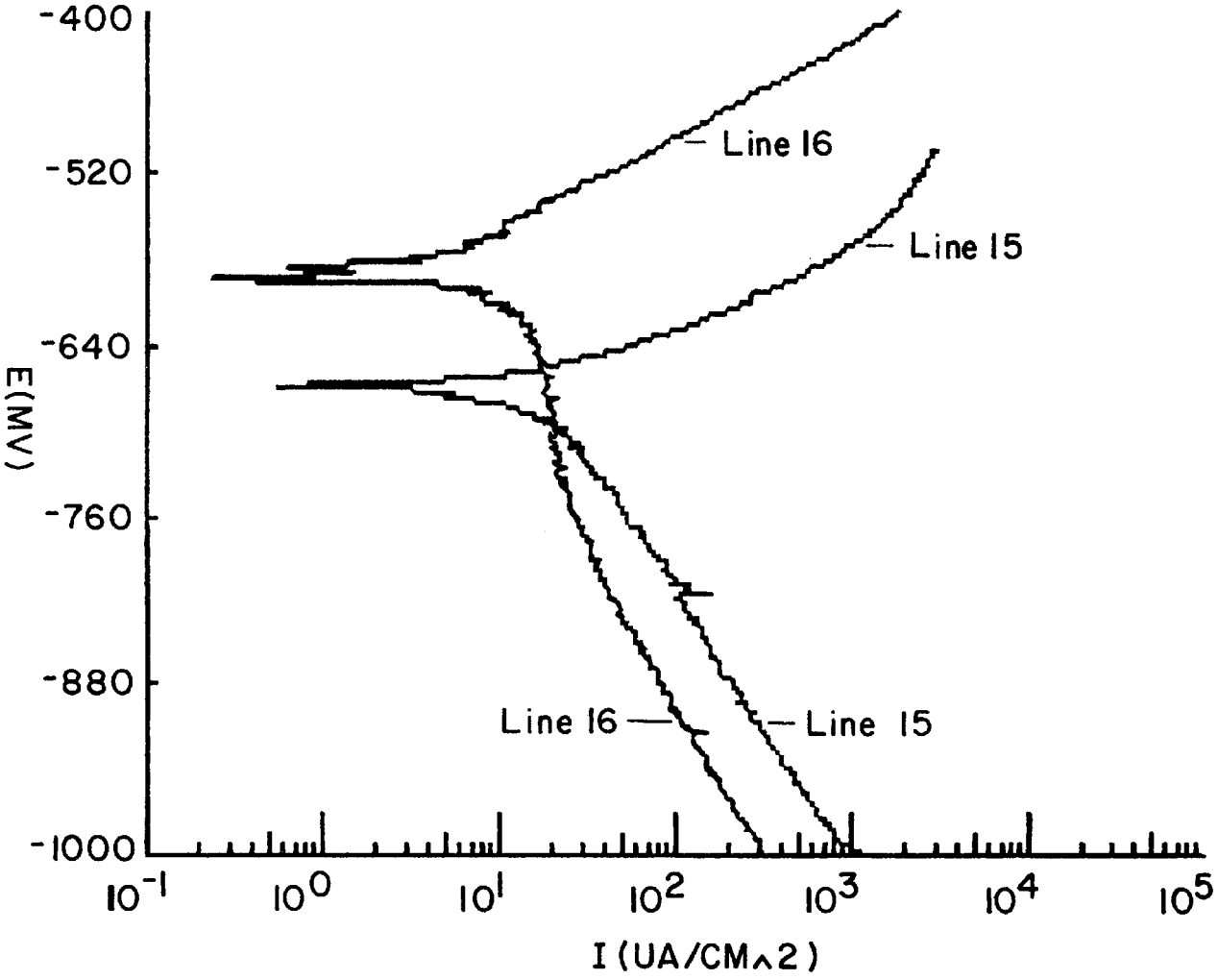
FIG. 5 illustrates, graphically, the performance of a corrosion inhibitor prepared in accordance with the present invention under deaerated conditions at a pH of 4.0.
Figure 6:
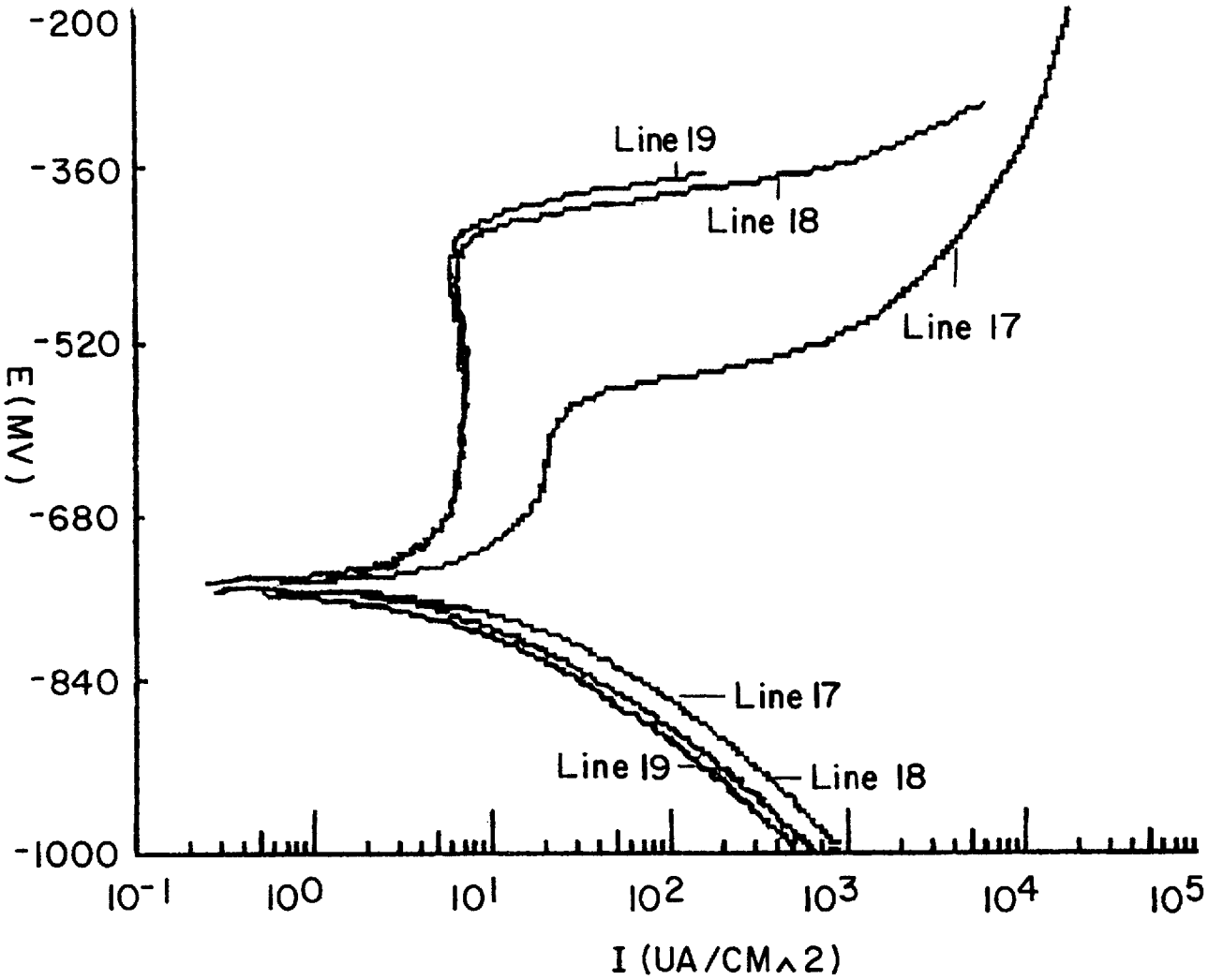
FIG. 6 illustrates, graphically, the performance of a corrosion inhibitor prepared in accordance with the present invention under deaerated conditions at a pH of 9.0.

Referring now to FIG. 5, line 16 represents the polarization curve of a system treated with a 1:1 ratio of sorbitan monostearate and polyoxyethylene 20 sorbitan monostearate each at a concentration of 30 ppm, in a similar test solution as described in Example 3 (0.1M perchlorate of 150° F.) at a pH of 4.0 under deaerated conditions. In comparison, line 15 represents the same system at the same pH level except that no corrosion inhibitor is added. It is evident that the combination of 30 ppm sorbitan monostearate and 30 ppm polyoxyethylene 20 sorbitan monostearate is effective under deaerated conditions and at a pH of 4.0. At a pH of 4.0 under deaerated conditions, the anodic inhibition is more significant than cathodic inhibition. In FIG. 6, at a pH of 9.0 under deaerated conditions, the polarization curve without any treatment (as represented by line 17) is compared to that with the above combination treatment in duplicate tests (as represented by lines 18 and 19). Good anodic inhibition is also observed at a pH of 9.0 as indicated in FIG. 6. Excellent reproducibility was observed in this work as shown by the agreement between line 18 and line 19.

EXAMPLE 5

Figure 7:
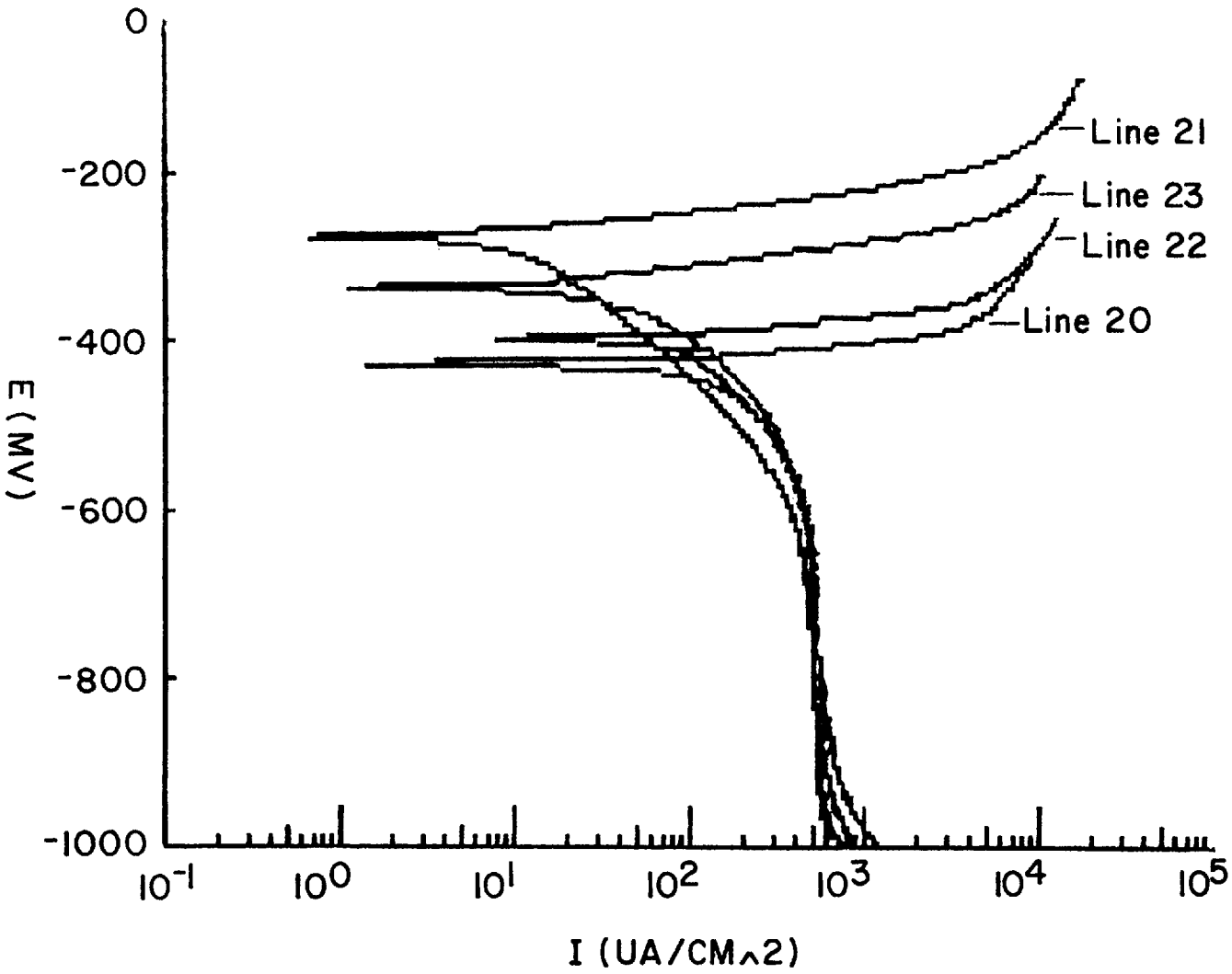
FIG. 7 illustrates, graphically the performance of a corrosion inhibitor prepared in accordance with the present invention on a mild steel electrode under aerated conditions and at varying pH levels using a rotating electrode.
Figure 8:
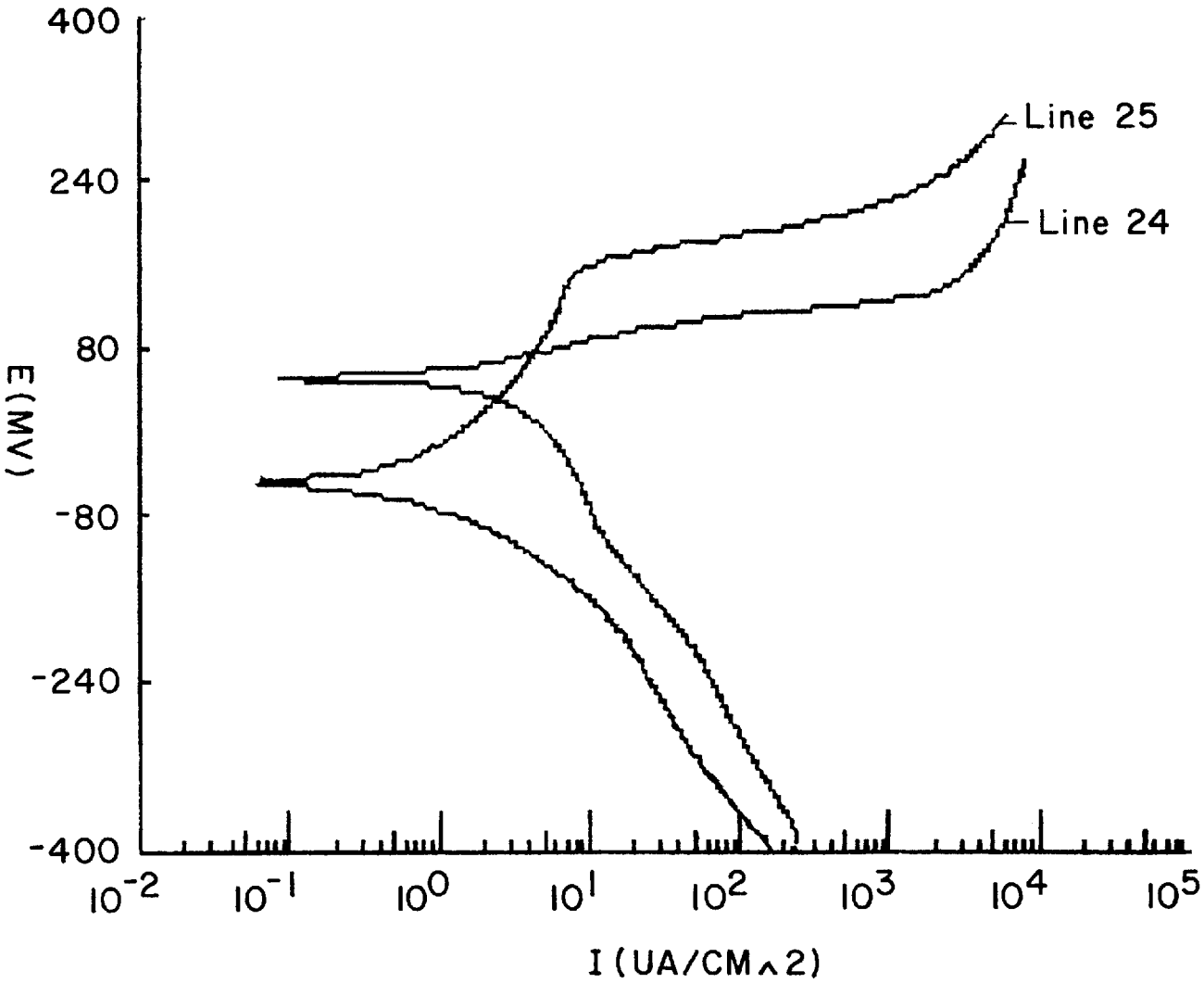
FIG. 8 illustrates, graphically, the performance of a corrosion inhibitor prepared in accordance with the present invention on a copper electrode under aerated conditions using a rotating electrode.

As illustrated in FIGS. 7 and 8, the use of 30 ppm sorbitan monostearate and 30 ppm polyoxyethylene 20 sorbitan monostearate is also effective in inhibiting corrosion on both steel and copper electrodes in an air-saturated or aerated system. The experiments represented by FIGS. 7 and 8 were performed using a rotating cylinder electrode at 150° F. at a rotation speed of 500 rpm. The system illustrated in FIG. 7 is a mild steel electrode and the system illustrated in FIG. 8 is a copper electrode.

Referring first to FIG. 7, line 20 represents the system at a pH level of 6.5, wherein no corrosion inhibitor is added. In contrast, line 21 represents the system at a pH of 6.5 treated with 30 ppm sorbitan monostearate and 30 ppm polyoxyethylene 20 sorbitan monostearate. A comparison of line 20 and line 21 shows that the corrosion inhibitor acts as an anodic inhibitor as the anodic dissolution is significantly reduced in the presence of the corrosion inhibitor under air-saturated conditions. Line 22 represents the same system at a pH level of 9.0 wherein no corrosion inhibitor is added. In contrast, line 23 represents the system at a pH of 9.0 treated with 30 ppm sorbitan monostearate and 30 ppm polyoxyethylene 20 sorbitan monostearate. Again the anodic dissolution rate was decreased in the presence of the corrosion inhibitor indicating that the combination of the surfactants was primarily an anodic inhibitor under air-saturated conditions. The corrosion inhibition effect of the composition at a pH of 6.5 is more significant than the corrosion inhibition effect of the composition at a pH of 9.0.

Referring to FIG. 8, line 24 represents the system at a pH of 6.5, a copper electrode, wherein no corrosion inhibitor is added. Line 25 (FIG. 8) represents the same system at a pH of 6.5 treated with 30 ppm sorbitan monostearate and 30 ppm polyoxyethylene 20 sorbitan monostearate. Again, a reduction in corrosion can be ascertained by Tafel extrapolation method under air-saturated conditions.

Thus, as illustrated in FIGS. 3–8, the combination of a sorbitan fatty acid ester with a polyoxyethylene derivative of a sorbitan fatty acid ester provides corrosion reduction for both steel and copper components, at varying pH levels under aerated and deaerated conditions. Because sorbitan fatty acid esters are believed to be at least less toxic and amine-free, it is believed that both families of compounds will be acceptable for use at least in the pharmaceutical, food processing, and beverage industries Suitable sorbitan fatty acid esters are sold under the following trademarks: SPAN 60 and ARLACEL 60 (sorbitan monostearate), SPAN 20 and ARLACEL 20 (sorbitan monolaurate), SPAN 40 and ARLACEL 40 (sorbitan monopalmitate), SPAN 65 (sorbitan tristearate), SPAN 80 and ARLACEL 80 (sorbitan monooleate), ARLACEL C and ARLACEL 83 (sorbitan sesquioleate) and SPAN 85 and ARLACEL 85 (sorbitan trioleate).

Suitable polyoxyethylene derivatives of a sorbitan fatty acid esters are sold under the following trademarks: TWEEN 20 (polyoxyethylene 20 sorbitan monolaurate), TWEEN 21 (polyoxyethylene 4 sorbitan monolaurate), TWEEN 40 (polyoxyethylene 20 sorbitan monopalmitate), TWEEN 60 (polyoxyethylene 20 sorbitan monostearate), TWEEN 61 (polyoxyethylene 20 sorbitan monostearate), TWEEN 65 (polyoxyethylene 20 sorbitan tristearate), TWEEN 80 (polyoxyethylene 20 sorbitan monooleate), TWEEN 81 (polyoxyethylene 5 sorbitan monooleate) and TWEEN 85 (polyoxyethylene 20 sorbitan trioleate).

It is believed that combinations of more than one sorbitan fatty acid ester with more than one polyoxyethylene derivatives of a sorbitan fatty acid esters will produce effective corrosion inhibitors as well. It is also believed that derivatives of sorbitan fatty acid esters other than polyoxyethylene derivatives may be utilized as one of the surfactants of the present invention.

It should be understood that various changes and modifications to the presently preferred embodiments described herein will be apparent to those skilled in the art.

Such changes can be made in the composition, operation and arrangement of the method of the present invention described herein without departing from the concept and scope of the invention as defined in the following claims:

We claim:

1. A method of inhibiting corrosion on metallic surfaces in contact with a fluid contained in an industrial fluid system which comprises adding to such fluid an effective corrosion controlling amount of a composition comprising:

a first surfactant wherein the first surfactant includes at least one sorbitan fatty acid ester; and, a second surfactant wherein the second surfactant includes at least one polyoxyethylene derivative of a sorbitan fatty acid ester.

2. The method according to claim 1, wherein at least one of the sorbitan fatty acid esters in the first surfactant is selected from the group consisting of: sorbitan tristearate; sorbitan monostearate; sorbitan monolaurate; sorbitan monopalmitate; sorbitan monooleate; sorbitan sesquioleate; and, sorbitan trioleate.

3. The method of claim 1, further comprising the addition of an emulsifier wherein the emulsifier is different from the first surfactant and the second surfactant.

4. The method according to claim 1, further comprising the addition of an emulsifier, being different from the first surfactant and the second surfactant, selected from the group consisting of: polyoxyethylene 20 sorbitan monolaurate; polyoxyethylene 4 sorbitan monolaurate; polyoxyethylene 20 sorbitan monostearate; and, polyoxyethylene 20 sorbitan monopalmitate.

5. The method according to claim 1, wherein at least one of the polyoxyethylene derivative of a sorbitan fatty acid ester in the second surfactant is selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate.

6. The method according to claim 1, wherein at least one of the sorbitan fatty acid ester in the first surfactant is selected from the group consisting of: sorbitan tristearate; sorbitan monostearate; sorbitan monolaurate; sorbitan monopalmitate; sorbitan monooleate; sorbitan sesquioleate; and, sorbitan trioleate; and, at least one of the polyoxyethylene derivatives of a sorbitan fatty acid ester in the second surfactant is selected from the group consisting of: polyoxyethylene 20 sorbitan monolaurate; polyoxyethylene 4 sorbitan monolaurate; polyoxyethylene 20 sorbitan monopalmitate; polyoxyethylene 20 sorbitan monostearate; polyoxyethylene 4 sorbitan monostearate; polyoxyethylene 20 sorbitan tristearate; polyoxyethylene 20 sorbitan monooleate; polyoxyethylene 5 sorbitan monooleate; and, polyoxyethylene 20 sorbitan trioleate.

7. The method of claim 2, further comprising the addition of an emulsifier, being different from the first surfactant and the second surfactant, selected from the group consisting of: polyoxyethylene 20 sorbitan monolaurate; polyoxyethylene 4 sorbitan monolaurate; polyoxyethylene 20 sorbitan monostearate; and, polyoxyethylene 20 sorbitan monopalmitate.

8. The method according to claim 1, wherein the weight ratio of first surfactant to the second surfactant is from about 1:3 to about 2:1.

9. The method of claim 7, wherein the weight ratio of first surfactant to the second surfactant to the emulsifier is from about 1:3:0.4 to about 2:1:0.3.

10. The method of claim 4, wherein the weight ratio of first surfactant to the second surfactant to the emulsifier is from about 1:3:0.4 to about 2:1:0.3.

11. The composition of claim 5, wherein the weight ratio of first surfactant to the second surfactant to the emulsifier is from about 1:3:0.4 to about 2:1:0.3.

12. The method according to claim 1, wherein the pH of the fluid is from about 4 to about 9.

13. The method according to claim 1, wherein the composition is added to the fluid so that the concentration of composition in the fluid ranges from about 0.1 ppm to about 500 ppm.

14. The method according to claim 7, wherein the composition is added to the fluid so that the concentration of composition in the fluid ranges from about 0.1 ppm to about 500 ppm.

15. The method according to claim 4, wherein the composition is added to the fluid so that the concentration of composition in the fluid ranges from about 0.1 ppm to about 500 ppm.

16. The method according to claim 5, wherein the composition is added to the fluid so that the concentration of composition in the fluid ranges from about 0.1 ppm to about 500 ppm.

17. The method according to claim 1, wherein the temperature of the fluid is from about 70° F. to about 550° F.

18. The method according to claim 1, wherein the fluid is an aqueous fluid.

19. The method according to claim 1, wherein the fluid is a non-aqueous fluid.

20. The method according to claim 1, wherein the industrial fluid system is selected from the group consisting of: cooling water systems; boiler systems; heat transfer systems; refinery systems; pulp and paper making systems; food and beverage systems; and, mechanical coolant systems.

* * * * *